US008704724B2

(12) United States Patent
Höök

(10) Patent No.: US 8,704,724 B2
(45) Date of Patent: Apr. 22, 2014

(54) METHOD AND ARRANGEMENT FOR A LOW RADAR CROSS SECTION ANTENNA

(75) Inventor: Anders Höök, Hindås (SE)

(73) Assignee: SAAB AB, Linköping (SE)

( * ) Notice: Subject to any disclaimer, the term of this patent is extended or adjusted under 35 U.S.C. 154(b) by 426 days.

(21) Appl. No.: 13/128,877

(22) PCT Filed: Nov. 12, 2008

(86) PCT No.: PCT/SE2008/051294

§ 371 (c)(1),
(2), (4) Date: Aug. 9, 2011

(87) PCT Pub. No.: WO2010/056160

PCT Pub. Date: May 20, 2010

(65) Prior Publication Data

US 2011/0291908 A1 Dec. 1, 2011

(51) Int. Cl.
*H01Q 1/52* (2006.01)

(52) U.S. Cl.
USPC ..... 343/841; 343/705; 343/708

(58) Field of Classification Search
USPC ..... 343/841, 705, 708, 773
See application file for complete search history.

(56) References Cited

U.S. PATENT DOCUMENTS 5,461,392 A 10/1995 Mott et al.
6,639,567 B2 * 10/2003 Chang et al. ..... 343/872
7,006,047 B2 * 2/2006 Marsan et al. ..... 343/705
7,009,572 B1 3/2006 Homer et al.
7,348,932 B1 3/2008 Puzella et al.
2005/0140561 A1 * 6/2005 Marsan et al. ..... 343/786
2007/0115199 A1 5/2007 Apostolos

FOREIGN PATENT DOCUMENTS

EP 1 965 462 A1 9/2008
EP 1 983 608 A1 10/2008

OTHER PUBLICATIONS

International Search Report, dated Jul. 9, 2009, issued in connection with counterpart International Patent Application No. PCT/SE2008/051294.

* cited by examiner

*Primary Examiner* — Ahshik Kim
(74) *Attorney, Agent, or Firm* — Venable LLP; Eric J. Franklin

(57) ABSTRACT

A low-radar cross section antenna structure for an active electrically scanned antenna including an active electrically scanned antenna enclosure and at least two antenna elements. The antenna elements are arranged to be mounted on a front surface of the active electrically scanned antenna enclosure and embedded in a lightweight structure. The front surface and side surfaces of the active electrically scanned antenna enclosure and the antenna elements are arranged to be covered with the lightweight structure. A thin laminate is arranged to cover an outer top surface and an outer side surface of the lightweight structure. Parts of the lightweight structure are arranged to be doped with a lossy material having dielectric, magnetic and/or resistive losses, thus making these parts of the lightweight structure absorbing for electromagnetic radiation.

32 Claims, 5 Drawing Sheets

METHOD AND ARRANGEMENT FOR A LOW RADAR CROSS SECTION ANTENNA

CROSS-REFERENCE TO RELATED APPLICATIONS

This application is the national phase under 35 U.S.C. §371 of PCT/SE2008/051294 filed 12 Nov. 2008.

TECHNICAL FIELD

The present invention relates to the field of low Radar Cross Section (RCS) antennas for objects or vehicles such as fighter aircrafts or missiles. The antennas are of the type Active Electrically Scanned Antenna (AESA).

BACKGROUND ART

There is a need today for creating a low radar signature for different objects such as e.g. aircrafts, i.e. to design aircrafts having a low radar visibility. Significant progress has been achieved in a number of problem areas as e.g.:

Intake/exhaust

Cockpit/canopy

Hull or fuselage shape

Absorbers

Armament but there is often a problem with reducing the passive signature of the aircraft sensors such as antennas.

A number of solutions have been proposed to achieve antennas with a low Radar Cross Section, RCS. The RCS value for an object depends on its size, shape, reflectivity and direction of the signal reflected from the object.

It is now familiar to most that a flat-plate antenna on a mechanical turntable is a major contributor to the RCS value of any fourth-generation fighter. A flat plate antenna is a passive, slotted waveguide antenna with a thin RF distribution network. Another way to put it is that there is limited reason to embark on a costly RCS reduction programme of a 4G aircraft as long as the flat-plate remains in place. It is also well-known that an Active Electrically Scanned Antenna (AESA) offers a lower RCS value than the flat-plate antenna.

However, it is not widely known that the RCS of an ordinary AESA is too high for any aircraft with substantial, low-RCS enabled abilities. This means that the tactics, number of aircraft, and other resources needed for an AESA-equipped 4G aircraft are comparable to what is required for a flat-plate 4G aircraft—mission for mission.

A stealth AESA, on the other hand, has an RCS so low that it enables an aircraft—provided the aircraft itself has a low RCS—to perform missions previously regarded out of reach for a 4G aircraft.

Most of the problems with existing stealth AESA solutions have been given unique solutions leading to high complexity, and consequently, a high cost. In some cases the performance is also limited. Some main problems are:

Difficulties to achieve wide-band matching.

Complexity is added by the introduction of absorbers for cross-polarized incident waves to an already complex antenna. Since it needs to support itself (or to be mounted against a supporting surface) against vibrations over the large aperture, complicated mechanical problems arise, especially since the absorber needs to be slotted.

A separate solution is required for absorption at the AESA side surfaces and at the base surface in order to reduce scattering adding further to the overall complexity.

Diffuse scattering from the antenna aperture.

The conventional hermeticity solution with a laminate cover worsens the RCS. The laminate cover needs to support its own mass against e.g. vibrations. This leads to a thickness that result in limitations of scannability and bandwidth.

There is thus a need to achieve a low RSC AESA for objects or vehicles such as fighters and missiles while at the same time offering improved handling and mechanical stability.

SUMMARY OF THE INVENTION

The object of the invention is to remove at least some of the above mentioned deficiencies with prior art solutions and to provide:

an antenna structure a method to manufacture an antenna structure to solve the problem of providing an AESA with improved handling and mechanical stability while at the same time achieving a low RCS.

This object is achieved by providing an antenna structure for an Active Electrically Scanned Antenna, AESA, with a low Radar Cross Section (RCS), comprising an AESA enclosure and at least two antenna elements. Said antenna elements being arranged to be mounted on a front surface of the AESA enclosure and embedded in a lightweight structure. The front surface and side surfaces of the AESA enclosure and the antenna elements are arranged to be covered with the lightweight structure wherein a thin laminate is arranged to cover an outer top surface and an outer side surface of the lightweight structure. Parts of the lightweight structure is further arranged to be doped with a lossy material having dielectric, magnetic and/or resistive losses, thus making these parts of the lightweight structure absorbing for electromagnetic radiation.

This object is further achieved by providing a method for arranging an antenna structure for an Active Electrically Scanned Antenna, AESA, with a low Radar Cross Section (RCS), comprising an AESA enclosure and at least two antenna elements. Said antenna elements are mounted on a front surface of the AESA enclosure and embedded in a lightweight structure. The front surface and side surfaces of the AESA enclosure and the antenna elements are covered with the lightweight structure wherein a thin laminate covers an outer top surface and an outer side surface of the lightweight structure. Parts of the lightweight structure are doped with a lossy material having dielectric, magnetic and/or resistive losses, thus making these parts of the lightweight structure absorbing for electromagnetic radiation.

Further advantages are explained below.

DETAILED DESCRIPTION

The invention will now be described in detail with reference to the drawings.

The stealth AESA is not a very wide-spread concept. There are several design principles such as:

- tapered (varying) reflection coefficient over the antenna aperture
- absorption of cross-polarized incident waves in the antenna aperture
- reduction of scattering from the sides of the AESA
- reduction of scattering from the surface on which the AESA is mounted
- narrow position tolerances of the antenna elements
- equal reflection (in phase and amplitude) in all antenna elements.

Most of these design principles have been given individual solutions leading to a high degree of complexity, and consequently, a high cost. The invention however provides an overall solution to achieve a low-RCS AESA or a stealth AESA.

The invention consists of a light but rigid lightweight structure, placed on the AESA. The lightweight material is preferably an electrically isotropic lightweight material, but also other materials, such as honeycomb can be used. Structural strength is increased by covering at least part of the lightweight structure with a very thin but strong laminate. RCS is reduced by letting part of the lightweight structure be doped with a lossy material, i.e. a material having dielectric, magnetic and/or resistive losses. This means that the lossy material can have dielectric, magnetic or resistive losses or any combination of these types of losses.

The laminate should be so thin, a few tens of a millimeter, that an incident wave passes without noticeable losses or reflection. In addition, the relative electrical permittivity E should be low, typically less than 4, and the resistivity σ should be negligible. All these required parameter values can be achieved simultaneously using standard laminates. The key advantage is that the laminate can be made much thinner than a conventional cover laminate without supportive lightweight material. A thinner laminate over a supportive lightweight material according to the invention means less reflections of incident waves from the laminate. As a further consequence and advantage of the invention, the ability to scan over the required bandwidth, i.e. the ability to receive and transmit over the required bandwidth in different directions, can be maintained with no increase of losses.

Figure 1A:
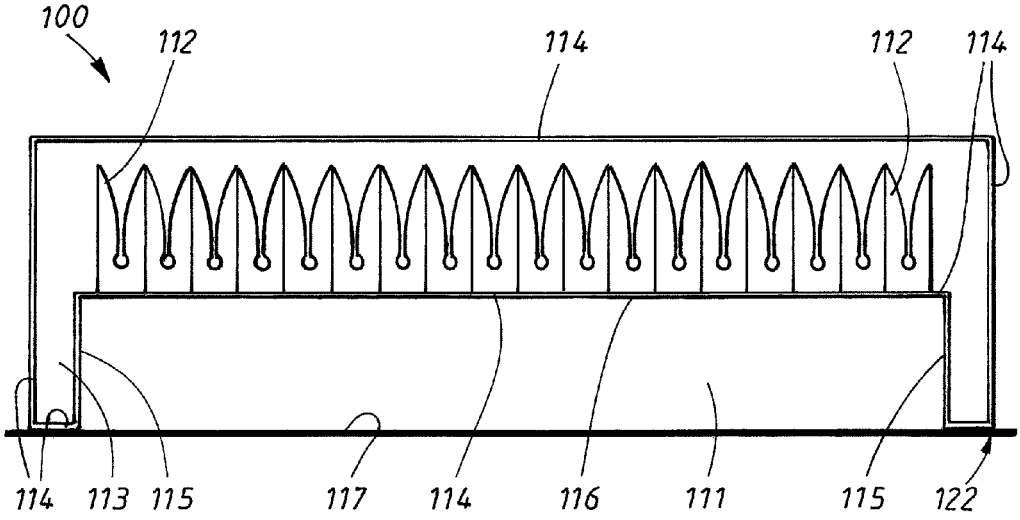
FIG. 1*a* schematically shows a cross section of the Active Electrically Scanned Antenna (AESA).
Figure 1B:
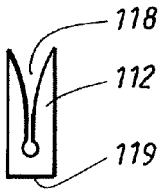
FIG. 1*b* schematically shows a front view of a flared notch antenna element.
Figure 1C:
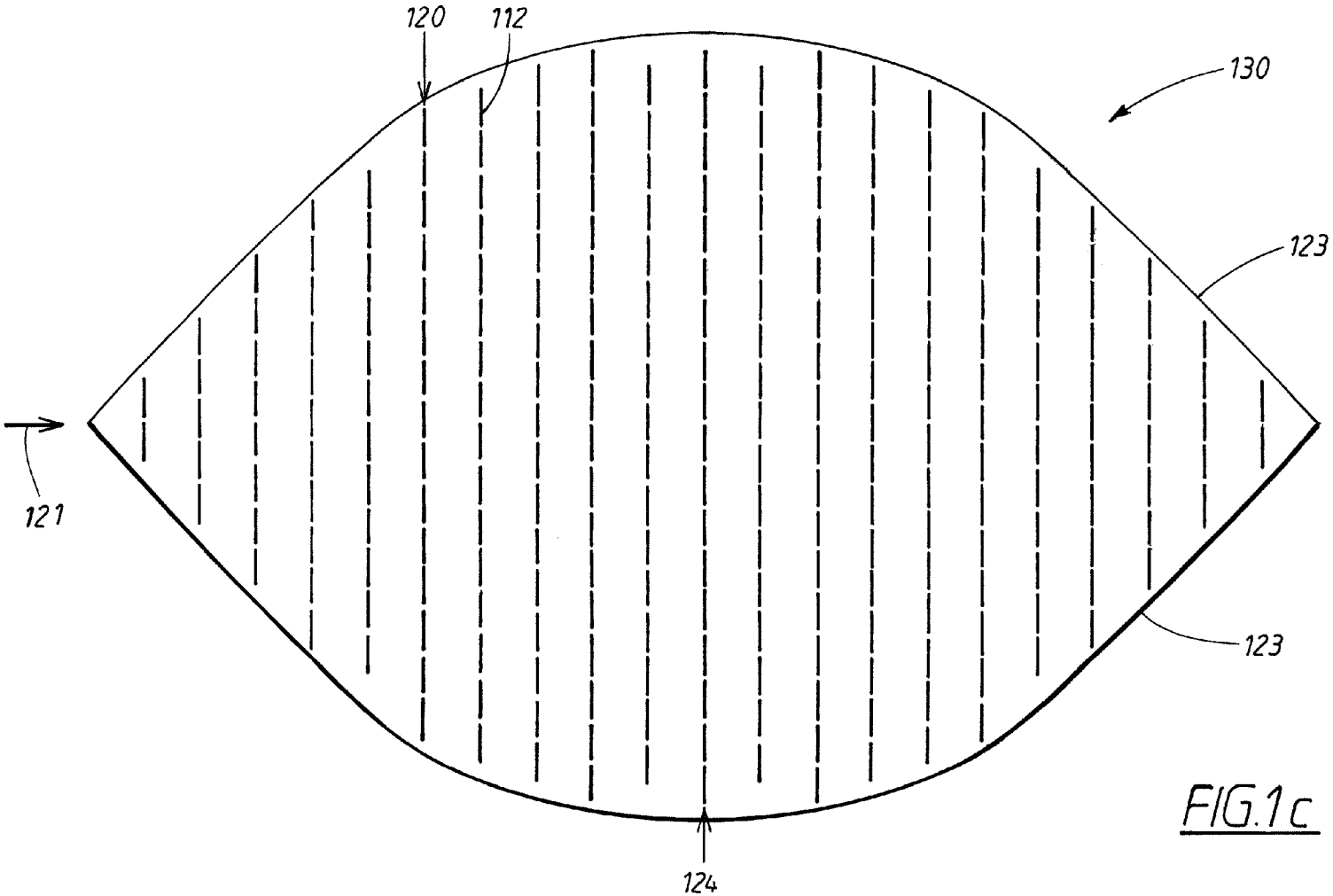
FIG. 1*c* schematically shows a top view of an antenna aperture.

FIG. 1 a shows an embodiment of the invention with a cross-section of a centre column 124 (see FIG. 1*c*) of the AESA 100 with an AESA enclosure, 111, and antenna elements 112 shown from the direction of arrow 121 in FIG. 1*c*. In this embodiment the centre column 124 has 18 antenna elements, see FIG. 1*c*. The antenna elements are part of the AESA having at least two antenna elements. The antenna elements are embedded in a lightweight structure 113, the lightweight structure having a thin laminate 114 preferably covering all outer surfaces of the lightweight structure. An outer surface of the lightweight structure is a surface not directly facing the AESA enclosure. Surfaces of the lightweight structure directly facing towards side surfaces 115 and a front surface 116 of the AESA enclosure are defined as inner surfaces and may also be covered with the thin laminate 114. The AESA enclosure comprises part of the feeding and matching arrangements to each antenna element. In an embodiment with the thin laminate 114 covering a part of the inner surface facing the front surface 116 of the AESA enclosure there are slots in the thin laminate to allow for the feeding of the antenna elements. FIG. 1*a* also shows a back surface 117 of the AESA enclosure and a mounting wall 122. Different examples of how the thin laminate can cover the lightweight structure are described further in association with FIG. 5.

FIG. 1*b* shows a front view of one flat antenna element 112 with its base 119 and notch 118, the notch being the radiating part of the antenna element. The example of FIG. 1*b* shows a flared notch element but also other elements, well known to the skilled person, can be used as e.g. a notch element. The antenna elements are preferably manufactured of a PCB laminate as will be described further. The feeding of the antenna element is preferably made with e.g. a stripline waveguide. Any other suitable feeding arrangement for the chosen antenna element is also within the scope of the invention.

FIG. 1*c* is a schematic top view of an antenna aperture 130 showing the antenna elements 112 being arranged on the antenna aperture 130 in M columns 120. The cross section of figure la shows the centre column 124 with 18 antenna elements. M is an integer value where M is greater than or equal to 2. The antenna aperture of FIG. 1*c* is a preferred shape adapted to the cross section of a nose section to a stealth aircraft. The antenna elements are preferably arranged in a regular lattice. The antenna elements within a column are typically located in the same two-dimensional plane and the distances between antenna elements in a column are normally equal as well as the distance between columns. The number of antenna elements can vary, from a few elements to more than a thousand, depending on the available size of the aperture. A typical antenna aperture hosts around 1000 antenna elements. The antenna elements closest to the perimeter 123 of the antenna aperture are called outer antenna elements and comprise antenna elements closest to the perimeter 123 and antenna elements having one or several antenna elements between itself and the perimeter. The major part of the antenna elements are called central antenna elements and are surrounded by the outer antenna elements.

Figure 2:
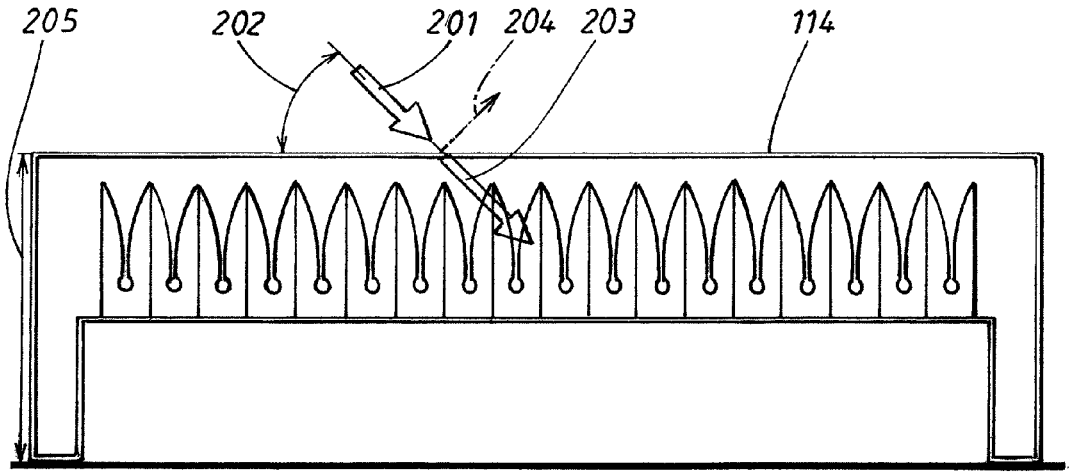
FIG. 2 schematically shows a cross section of the Active Electrically Scanned Antenna (AESA) illustrating incident waves to the AESA.

The thin laminate 114 may, as mentioned, be put entirely around the lightweight structure, as indicated in FIGS. 1 and 2. If so, the laminate is placed not only above the antenna elements, but also at their bases. This reinforces the long, rib-like lightweight structure so that mounting and demounting of the lightweight structure can be made without risking to break the lightweight material.

FIG. 2 shows the same cross section of the AESA as in FIG. 1*a* with incoming radiation symbolized with arrow 201 having an incident angle 202. The low losses, the moderate permittivity and the thin thickness of the thin laminate 114 ensures that virtually all incoming radiation reaches the antenna elements and only a small fraction 204 is reflected at the laminate surface. The radiation reaching the antenna elements is denoted 203. This is valid also for high angles of incidence, i.e. close to 90°, and near the frequency limit of the AESA.

Antenna elements made by metal may withstand the mechanical strains associated with flight. Moreover, they can be fabricated with narrow tolerances, a necessary (but not sufficient) prerequisite for low antenna RCS. However, they are expensive to manufacture, and separate feeding laminates must nevertheless be manufactured, increasing the cost even further.

Short antenna elements:

- can withstand stress and vibrations better than long antenna elements
- exhibit a limited bandwidth-scan product. This leads to reduced antenna element performance and increased RCS.
- keep the height, indicated with arrow 205 in FIG. 2, of the AESA down.

However, the height is not very critical, as:

- an element-driven height increase does not increase weight by a prohibitive amount
- a height increase does not noticeable reduce the available aperture area for a supersonic fighter.

Moreover, long antenna elements have the advantage that they can result in a lower antenna RCS since they can absorb incident radiation over a wide frequency band.

Long antenna elements including feeding lines, as e.g. flared notch elements, applied to PCB (Printed Circuit Board) substrates by etching, can be manufactured in a low-cost production method with narrow tolerances along the PCB-surface and are therefore ideal to use as antenna elements 112. This means that a separate feeding laminate is not required, which is an advantage compared to the situation when using a metal antenna as described above. However, the long PCB substrates bend easily, so they must be stabilized in directions normal to the PCB surface. Also other types of antenna elements can be applied to the PCB substrate by any suitable production method. A long antenna element has a length of at least a half wavelength, typically several wavelengths, of the upper operating frequency limit of the AESA.

An advantage of the present invention is its ability to keep long, low-cost and wide-band PCB-etched antenna elements located to positions within required tolerances. This is accomplished by the PCB substrates, comprising the antenna elements, being inserted into wedges or slots in the lightweight structure. When the PCB substrates are pressed into the wedges or slots in the lightweight structure the resulting pressure on the lightweight structure is transferred to the thin PCB substrate at the upper part of the PCB substrate and thus stabilizes the PCB substrates into the desired positions.

Figure 3:
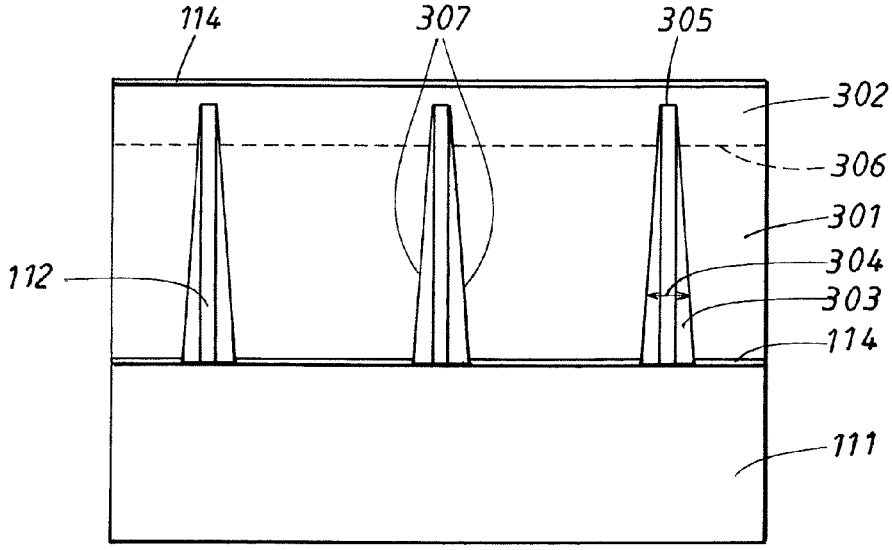
FIG. 3 schematically shows a cross section of a part of the AESA with antenna elements in wedge shaped slots of the lightweight structure.

The lightweight structure is machined in at least two parts, preferably in one thick, lower lightweight structure 301 and one thinner, upper lightweight structure 302. The upper lightweight structure is thus thinner than the lower lightweight structure. FIG. 3 is a cross section of the AESA across the antenna elements 112. The antenna elements are in this embodiment placed in wedge-shaped slots 303 in the lightweight structure. The width, 304, of the slot is preferably successively decreasing towards the top, 305, in the upper part of the slot. The slots run through the lower lightweight structure and end in the upper lightweight structure. The top of the slot and the upper part of the slot is located in the upper lightweight structure 302. The slotted lightweight structure stabilizes each antenna element at the upper part of the antenna element. The upper and lower parts of the lightweight structure are joined at the dashed line 306. The width of the slot at the base of the antenna element shown in FIG. 3 is exaggerated for clarity reasons. The example of FIG. 3 also shows part of the AESA enclosure 111 and parts of the thin laminate 114. One column of antenna elements is inserted in each slot, i.e. there are as many slots as there are columns.

The ability to realize a tapering over the outer elements, useful for suppressing co-polarized incident waves, depends on having as small separation as possible between the lightweight material surfaces 307 of the slots and the adjacent PCB surfaces, i.e. the antenna elements have to be closely surrounded by the doped lightweight material in order to achieve a suitable attenuation. If it is considered too cumbersome e.g. from a manufacturing point of view to have a sufficiently small, said separation, a thin layer of lossy material can, as an alternative, be fastened onto the part of the PCB that comprises outer antenna elements, prior to mounting the lightweight structure. The tapering effect will be described in detail in association with FIG. 5.

The narrow-tolerance requirement in the position transverse to the antenna elements need only be maintained during machining of the upper lightweight structure 302. This is facilitated by the fact that the upper lightweight structure is thin and by the fact that it is stabilized by the thin laminate 114 mentioned previously. Narrow tolerances are facilitated by choosing the material of the lightweight structure 301/302 to be foam, rather than honeycomb. The narrow tolerances in the position of the antenna elements avoids diffuse scattering from the antenna aperture of the antenna structure. Wide tolerances in the positions of the antenna elements cause a diffuse scattering that increases RCS near the main lobe and near the grating lobes.

Lightweight materials are sensitive to abrasion. Therefore, the side surfaces of the slots in the upper lightweight structure 302 can be treated with some friction lowering material and/or some surface sealing material such as paint. This is more feasible to do if the lightweight material is foam, rather than honeycomb.

Figure 4:
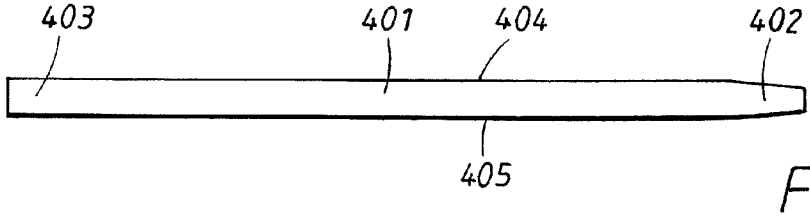
FIG. 4 schematically shows a side view of an antenna element.

FIG. 4 shows a side view of an antenna element realized on a PCB substrate 401 with a first surface 404 and a second surface 405 and with a top part 402 of the antenna element, in this case the PCB substrate, having a shape suitable to be pressed into the top, 305, of the slot 303. The top of the slot can preferably be wedge shaped. Both surfaces 404 and 405 of the top part 402 can e.g. preferably be bevel-edged as shown in FIG. 4. The base part 403 of the antenna element is mounted to the AESA enclosure in any conventional way well known to the skilled person.

The lightweight structure should be assembled using the antenna elements as an assembly rig. This means that when the upper lightweight structure 302 is applied to the lower lightweight structure 301, by using e.g. gluing, the antenna elements should be in place. The upper lightweight structure 302 need not be steered in lateral position except the steering obtained by the entire collection of antenna elements. This implies further that the top parts of the antenna elements will be positioned well relative to each other, but that the position of the lattice of antenna elements, may differ from a nominal position. This is acceptable since a deviation of the entire lattice will not add to the RCS, as RCS from a scattering object is independent of the position of the lattice.

Figure 5:
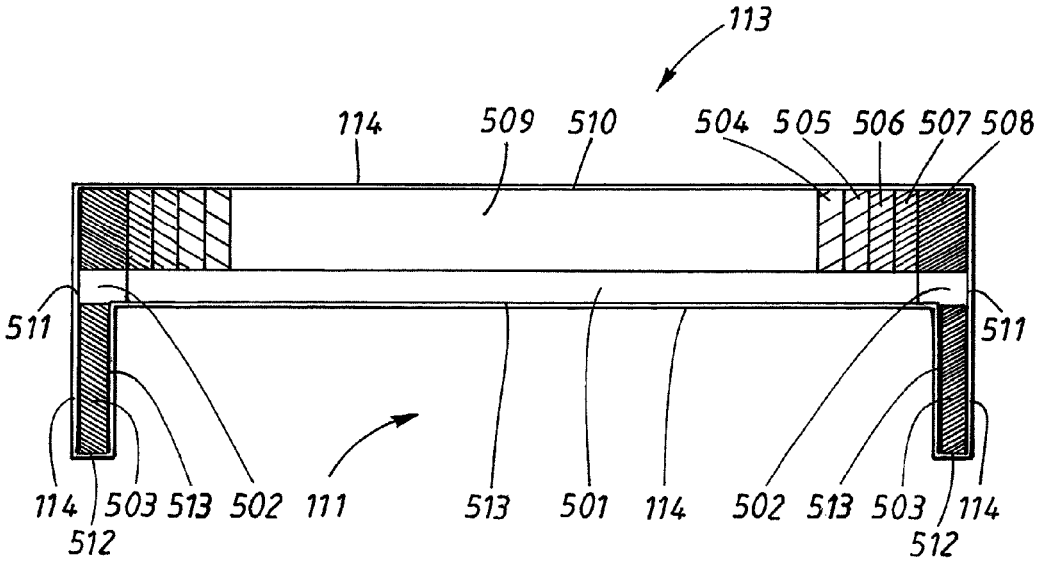
FIG. 5 schematically shows the lightweight structure with absorbing parts.

FIG. 5 is a cross section of the lightweight structure 113, in this embodiment surrounded by the thin laminate 114. The thin laminate covers the outer top surface 510 and outer side surface 511 and a wall-facing part 512 of the outer surface as well as the inner surfaces 513 of the lightweight structure. The wall-facing part 512 is defined as a part of the outer surface of the lightweight structure directly facing the mounting wall 122. The outer surfaces thus comprise three parts, the outer top surface 510, the outer side surface 511 and the wall-facing part 512. In another embodiment only the outer top surface 510 and the outer side surface 511, need to be covered with the thin laminate. In a further embodiment all outer surfaces including the wall-facing part 512 are covered with the thin laminate. The part of the thin laminate covering the wall-facing part 512 of the outer surfaces of the light weight structure contributes to improving the hermeticity of the antenna structure and is an additional advantage of the invention. When the porous lightweight structure is covered with the thin laminate, this part of the surface of the lightweight structure will become non-porous. The hermiticity will be improved when the non-porous surfaces of the lightweight structure are mounted towards the non-porous surface of the mounting wall.

As mentioned in association with FIG. 1*c* the inner surfaces 513 may be covered with the thin laminate. The inner surfaces can in other embodiments be without the thin laminate.

FIG. 5 also shows parts of the lightweight structure doped with a lossy material in order to absorb cross-polarized and/or co-polarized incident waves at certain positions. The doped parts 501-508 of the lightweight structure thus are becoming absorbing for electromagnetic radiation. The thin laminate 114, explained earlier, is also shown as well as the position for the AESA enclosure 111. Tapering parts 504-508 comprising absorbing lightweight material are shown in FIG. 5 with different line patterns. A closer distance between the lines in the pattern illustrates a higher absorbing property. To get more absorbing properties the material shall have more losses, e.g. the lightweight material can be doped with more resistive material to obtain increased losses. Examples of materials that can be used for doping the lightweight structure are carbon filaments or carbon nano-tubes. An example of a material that can be used for doping a lightweight structure made of honeycomb is a layer of carbon particles constituting a film that covers surfaces of the honeycomb material. The amount of absorption of electromagnetic radiation in the different parts of the lightweight material can be controlled with the amount of dopant and range from a few percent to close to 100%.

Following parts of the lightweight structure should preferably be absorbing:

- a bottom part 501. The bottom part 501 of the lightweight structure is located at the base parts 403 of the antenna elements and extends along and covers the antenna aperture 130, comprising the main part of the front surface 116 of the AESA enclosure. The bottom part 501 absorbs most of the cross-polarized components of the incident waves. The co-polarized components are mostly absorbed by the antenna elements.
- an extended bottom part 502. The above mentioned bottom part 501 is preferably extended outside the area of the antenna elements all the way out to the thin laminate in order to absorb both polarizations, cross- and co-polarized, of the incident waves hitting this part, being an extension of the bottom part 501, defined as the extended bottom part 502. The extended bottom part surrounds the bottom part 501. In this example, antenna elements are only positioned in the area covered by the bottom part 501.
- side parts 503. Absorbing lightweight material covers side surfaces 115 of the AESA enclosure 111. These side parts 503 of the lightweight structure 113 will suppress the TEM-like waves that may enter—and reflect—there, due to the fact that this area has the geometry of a TEM-waveguide. A TEM wave is a wave having a Transverse polarisation of the Electric and Magnetic (TEM) fields. Absorbing lightweight material may also be necessary in this region to cover edges of the AESA enclosure in order to suppress edge scattering.
- the tapering parts 504-508. Absorbing lightweight material should cover the outer antenna elements to realize a certain tapering of the antenna elements. This is illustrated by tapering parts 504-508 of the lightweight structure 113 preferably having increasing losses in the direction towards the outer side surface 511 of the lightweight structure. In other embodiments the tapering parts can have constant losses, i.e. they all have the same loss which means that the tapering is zero.

The mid section 509 of the lightweight structure is lossless, i.e. it is not doped with any lossy material.

The lightweight structure 113 thus comprises of a lossless part 509 and following parts, preferably with absorbing lightweight material:

- the bottom part 501
- the extended bottom part 502 surrounding the bottom part
- the side parts 503 and
- the tapering parts 504-508.

The tapering of the antenna elements means that the outer antenna elements are embedded in a lightweight material having the property of causing increasing losses, to incident or receiving waves and transmitted waves, the closer the lightweight material comes to the outer side surface 511 of the lightweight structure. The tapering causes the current distribution along the aperture 130 of the antenna structure to have a maximum in the centre and then a successively decreasing absolute current value towards the outer antenna elements of the antenna structure. This current distribution has the positive effect of reducing the RCS in certain directions.

The low Radar Cross Section (RCS) property of the invention is thus accomplished by:

- introducing the thin laminate 114 covering at least part of the lightweight structure instead of a conventional and thicker cover laminate without supportive lightweight material.
- providing parts of the lightweight structure with absorbing parts thus reducing reflected electromagnetic radiation from the antenna structure
- providing narrow tolerances in the position of the antenna elements which avoids diffuse scattering from the aperture surface of the antenna structure
- providing equalized matching for the inner antenna elements due to the suppression of reflected waves from the antenna perimeter.

Figure 6:
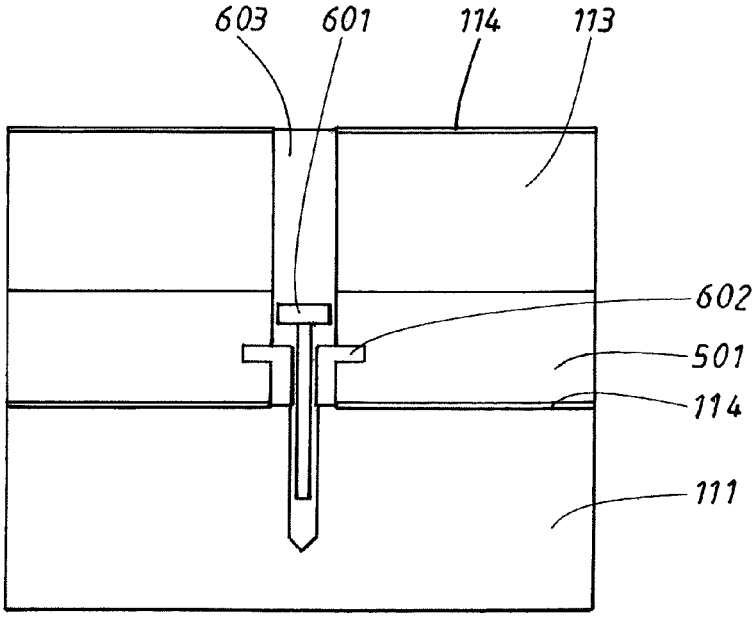
FIG. 6 schematically show fastening means.

The friction fastening of the lightweight structure to the AESA enclosure should be assisted by fastening means such as a few, say 6-12, small plastic screws 601 with plastic inserts 602 as illustrated in FIG. 6. The screws are mounted through a hole 603 through the thin laminate 114, the lightweight structure 113, the absorbing lightweight material in the bottom part 501, the thin laminate 114 and the AESA enclosure 111.

Figure 7:
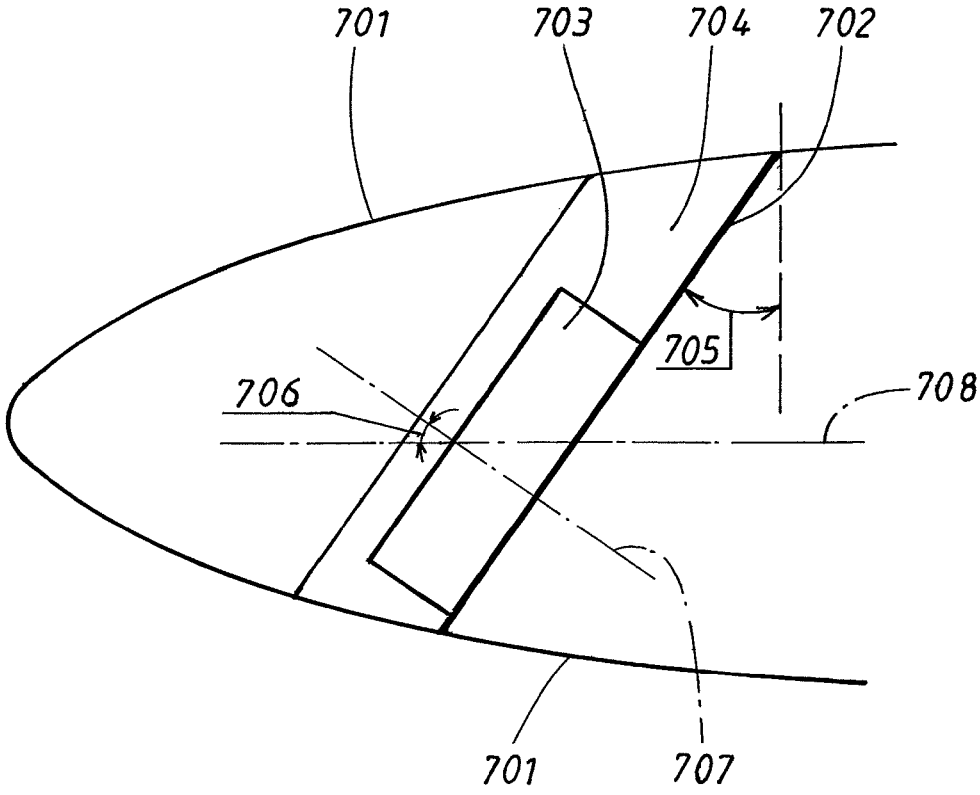
FIG. 7 schematically shows a side view of the AESA mounted in a nose section of an aircraft.

Finally, the outer side surface 511 of the lightweight structure should preferably follow the shape of the radome to the AESA, the radome being shaped for an optimum blend of aerodynamic and RCS performance. This design will maximize the absorption of incident radiation entering the region between the side surfaces of the AESA and the radome. This could, for instance lead to an asymmetric shape of the lightweight structure according to FIG. 7 showing a side view of the AESA mounted inside a radome 701 forming a nose section of a fighter aircraft. The AESA 100 with the AESA enclosure 703 and the lightweight structure 704 is mounted on the mounting wall 702 of the nose section. From this side view the lightweight structure thus has an asymmetric shape. The mounting wall in this example is slanted in order to point the AESA in the desired direction and to direct the aperture reflections upwards, away from a transmitter most likely to be located approximately straight in front of the nose section.

For clarity reasons FIGS. 1, 2, 3, 5 and 6 show the AESA when a slant angle 705 is 90°. In practical installations, as in this example in a stealth aircraft, the slant angle 705 is about 5-20°. The invention is however applicable to any slant angle.

Simple trigonometry also gives that the slant angle 705 equals an angle 706 between a normal 707 to the antenna aperture and a horizontal plane 707.

The proposed lightweight structure efficiently reduces all RCS contributions from the exterior of the AESA, including the scattering from the outer antenna elements. It offers stability at low-cost and low-RCS antenna elements and may improve on the hermeticity required by the antenna. A good hermeticity prevents dust, trash and humidity to get in contact with the antenna elements and thus affect the performance of the antenna. The hermetic enclosure of the antenna elements also protects the antenna elements from being touched which could alter the performance.

The antenna aperture can have a shape as shown in FIG. 1*c* or any shape suitable for the application as e.g. circular or elliptical. The design of the AESA enclosure can be adapted to the application. A preferred design of the side surfaces 115 of the AESA enclosure is to resemble the shape of the radome as this shape is designed to minimize RCS. The lightweight structure can also have various shapes, e.g. to follow the shape of the radome as explained in FIG. 7. Thus the different parts, 501-509, of the lightweight structure do not necessarily have to have a rectangular cross-section as depicted in FIG. 5.

The invention is not limited to the embodiments and examples above, but may vary freely within the scope of the appended claims.

The invention claimed is:

1. An antenna structure for an active electrically scanned antenna with a low radar cross-section, the antenna structure comprising:

an active electrically scanned antenna enclosure, at least two antenna elements, said antenna elements being arranged to be mounted on a front surface of the active electrically scanned antenna enclosure and embedded in a lightweight structure, wherein the front surface and side surfaces of the active electrically scanned antenna enclosure and the antenna elements are arranged to be covered with the lightweight structure, and a thin laminate arranged to cover an outer top surface and an outer side surface of the lightweight structure, wherein parts of the lightweight structure are arranged to be doped with a lossy material having dielectric, magnetic and/or resistive losses, thus making these parts of the lightweight structure absorbing for electromagnetic radiation.

2. The antenna structure according to claim 1, wherein the thin laminate is arranged to cover also a wall-facing part of the outer surfaces of the lightweight structure.

3. The antenna structure according to claim 1, wherein the thin laminate is arranged to cover also inner surfaces of the lightweight structure directly facing towards the front and the side surfaces of the active electrically scanned antenna enclosure.

4. The antenna structure according to claim 1, wherein the antenna elements are arranged in a lattice with M columns, where M is an integer value greater than or equal to 2.

5. The antenna structure according to claim 1, wherein the antenna elements are notch elements.

6. The antenna structure according to claim 1, wherein the antenna elements are arranged to be applied to printed circuit board substrates.

7. The antenna structure according to claim 1, wherein the lightweight structure comprises two parts, a lower lightweight structure and an upper lightweight structure, the upper lightweight structure being thinner than the lower lightweight structure.

8. The antenna structure according to claim 1, wherein the antenna elements are arranged to be placed in slots in the lightweight structure.

9. The antenna structure according to claim 1, wherein the antenna elements have a top part and a base part, the top part having a bevel-edged shape suitable to be pressed into a top of the slot and the base part arranged to be mounted to the active electrically scanned antenna enclosure.

10. The antenna structure according to claim 1, wherein the lightweight structure covering outer antenna elements comprises tapering parts of absorbing lightweight material having constant or increasing losses in the direction towards the outer side surface of the lightweight structure.

11. The antenna structure according to claim 1, wherein a bottom part and an extended bottom part of the lightweight structure comprises absorbing lightweight material, the bottom part extending along and covering the main part of the front surface of the active electrically scanned antenna enclosure and the extended bottom part being an extension surrounding the bottom part.

12. The antenna structure according claim 1, wherein side parts of the lightweight structure between the active electrically scanned antenna enclosure and the inner sides of the radome comprise absorbing lightweight material.

13. The antenna structure according to claim 1, wherein the lightweight structure is arranged to be fastened to the active electrically scanned antenna enclosure with a fastener.

14. The antenna structure according to claim 1, wherein the lightweight structure has an asymmetric shape seen from a side view.

15. The antenna structure according to claim 1, wherein the side surfaces of the active electrically scanned antenna enclosure has a design resembling the shape of the radome.

16. The antenna structure according to claim 1, wherein the antenna elements are placed in wedge shaped slots and a thin layer of lossy material is arranged to be fastened onto the outer antenna elements.

17. A method for arranging structure for an active electrically scanned antenna with a low radar cross section comprising an active electrically scanned antenna enclosure and at least two antenna elements, said antenna elements being mounted on a front surface of the active electrically scanned antenna enclosure and embedded in a lightweight structure, where the front surface and side surfaces of the active electrically scanned antenna enclosure and the antenna elements are covered with the lightweight structure, wherein a thin laminate covers an outer top surface and an outer side surface of the lightweight structure, and wherein parts of the lightweight structure are doped with a lossy material having dielectric, magnetic and/or resistive losses, thus making these parts of the lightweight structure absorbing for electromagnetic radiation.

18. The method according to claim 17, wherein the thin laminate is arranged to cover also a wall-facing part of the outer surfaces of the lightweight structure.

19. The method according to claim 17, wherein the thin laminate covers also inner surfaces of the lightweight structure directly facing towards the front and the side surfaces of the active electrically scanned antenna enclosure.

20. The method according to claim 17, wherein the antenna elements are arranged in a lattice with M columns, where M is an integer value greater than or equal to 2.

21. The method according to claim 17, wherein the antenna elements are notch elements.

22. The method according to claim 17, wherein the antenna elements are applied to printed circuit board substrates.

23. The method according to claim 17, wherein the lightweight structure is manufactured from two parts, a lower lightweight structure and an upper lightweight structure, the upper lightweight structure being thinner than the lower lightweight structure.

24. The method according to claim 17, wherein the antenna elements are placed in slots in the lightweight structure.

25. The method according to claim 17, wherein the antenna elements have a top part and a base part the top part having a bevel-edged shape suitable to be pressed into a top of the slot and the base part being mounted to the active electrically scanned antenna enclosure.

26. The method according to claim 17, wherein the lightweight structure covering outer antenna elements comprises tapering parts of absorbing lightweight material having constant or increasing losses in the direction towards the outer side surface of the lightweight structure.

27. The method according to claim 17, wherein a bottom part and an extended bottom part of the lightweight structure comprises absorbing lightweight material, the bottom part extending along and covering the main part of the front surface of the active electrically scanned antenna enclosure and the extended bottom part being an extension surrounding the bottom part.

28. The method according to claim 17, wherein side parts of the lightweight structure between the active electrically scanned antenna enclosure and the inner sides of the radome comprise absorbing lightweight material.

29. The method according to claim 17, wherein the lightweight structure is fastened to the AESA active electrically scanned antenna enclosure with a fastener.

30. The method according to claim 17, wherein the lightweight structure has an asymmetric shape seen from a side view.

31. The method according to claim 17, wherein the side surfaces of the active electrically scanned antenna enclosure has a design resembling the shape of the radome.

32. The method according to claim 17, wherein the antenna elements are placed in wedge shaped slots and a thin layer of lossy material is arranged to be fastened onto the outer antenna elements.

* * * * *